US008142067B2

(12) United States Patent
Dorado Gonzalez et al.

(10) Patent No.: US 8,142,067 B2
(45) Date of Patent: Mar. 27, 2012

(54) ELECTROMAGNETIC AXIAL AGITATOR

(75) Inventors: Manuel Dorado Gonzalez, Madrid (ES); Carlos Montero Catalina, Alcorcón (ES); Josè Manuel Herrero Alonso, Madrid (ES)

(73) Assignee: Cirta, S.L., Madrid (ES)

( * ) Notice: Subject to any disclaimer, the term of this patent is extended or adjusted under 35 U.S.C. 154(b) by 438 days.

(21) Appl. No.: 12/526,475

(22) PCT Filed: Feb. 7, 2007

(86) PCT No.: PCT/ES2007/000061

§ 371 (c)(1), (2), (4) Date: Aug. 7, 2009

(87) PCT Pub. No.: WO2008/096018

PCT Pub. Date: Aug. 14, 2008

(65) Prior Publication Data

US 2010/0039886 A1 Feb. 18, 2010

(51) Int. Cl.
*B01F 11/00* (2006.01)

(52) U.S. Cl. ..... 366/110; 366/112; 366/212

(58) Field of Classification Search ..... 366/110–112, 366/116, 212

See application file for complete search history.

(56) References Cited

U.S. PATENT DOCUMENTS

| | | | | |
|---|---|---|---|---|
| 1,986,038 | A * | 1/1935 | Zielke | 366/112 |
| 2,116,367 | A * | 5/1938 | Smith | 366/110 |
| 2,356,004 | A * | 8/1944 | Price | 366/110 |
| 3,151,846 | A * | 10/1964 | George | 366/112 |
| 3,635,446 | A | 1/1972 | Kurosawa et al. | |
| 4,265,544 | A | 5/1981 | Banno et al. | |
| 4,305,668 | A | 12/1981 | Bilbrey | |
| 4,820,054 | A | 4/1989 | Wong | |
| 4,883,644 | A | 11/1989 | Perlman | |
| 5,141,327 | A | 8/1992 | Shiobara | |
| 5,176,446 | A | 1/1993 | Chiba et al. | |
| 5,558,437 | A | 9/1996 | Rode | |
| 5,921,477 | A * | 7/1999 | Tomes et al. | 241/2 |
| 6,659,637 | B2 * | 12/2003 | Friedman | 366/212 |
| 7,270,472 | B2 * | 9/2007 | Carreras | 366/111 |
| 2002/0044495 | A1 * | 4/2002 | Friedman | 366/212 |
| 2005/0088912 | A1 | 4/2005 | Brauch et al. | |
| 2005/0180258 | A1 | 8/2005 | Czarnek | |
| 2006/0187743 | A1 * | 8/2006 | Carreras | 366/111 |

FOREIGN PATENT DOCUMENTS

| | | |
|---|---|---|
| CA | 2124023 | 11/1994 |
| DE | 20 2004 013 715 | 2/2005 |
| ES | 219812 | 3/1955 |
| ES | 188622 | 9/1974 |
| ES | 251 833 | 11/1980 |
| ES | 251833 | 11/1980 |
| ES | 2 039 656 | 8/1989 |
| ES | 2 064 649 | 4/1991 |
| ES | 2 113 572 | 5/1998 |
| ES | 2 160 401 | 11/1999 |

(Continued)

*Primary Examiner* — David Sorkin

(74) *Attorney, Agent, or Firm* — Merchant & Gould P.C.

(57) ABSTRACT

Apparatus which axially stirs solid and/or liquid and/or gaseous substances jointly or individually, characterized by the use of a linear motor or linear servo motor, which enables to select the amplitude, frequency, acceleration, application time of said movement and selection of stirring and rest cycles. The stirring produced by this apparatus can be applied for mixing and/or homogenizing substances and/or extracting the constituent elements of the stirred substances.

9 Claims, 1 Drawing Sheet

FOREIGN PATENT DOCUMENTS

| | | |
|---|---|---|
| ES | 219 812 | 1/2005 |
| GB | 1 180 278 | 2/1970 |
| WO | WO 86/00995 | 2/1986 |
| WO | WO 98/31457 | 7/1998 |

* cited by examiner

ELECTROMAGNETIC AXIAL AGITATOR

This application is a National Stage Application of PCT/Es2007/000061, filed 7 Feb. 2007, and which application is incorporated herein by reference. To the extent appropriate, a claim of priority is made to the above disclosed application.

The present invention refers to an apparatus which axially stirs solid and/or liquid and/or gaseous substances individually or jointly.

This invention is especially designed for laboratory use, industrial and/or domestic applications requiring this kind of axial stirring in order to mix or homogenize substances and/or carry out extraction processes.

The present invention refers to the field of stirring and/or mixing and/or homogenization and/or substance extraction.

BACKGROUND OF THE INVENTION

Nowadays, most chemical analysis methods require the stirring of samples to obtain a proper homogenization, fluidization or mixing of all the substances in that sample, or to carry out extraction processes of some of the constituents of the sample. Stirring apparatuses currently used perform orbital stirring, rotational stirring, vibration stirring, swinging stirring, magnetic stirring, propeller stirring and pendular stirring.

Orbital stirring (WO86/00995, US005558437A) consists of making the sample follow a circular or elliptical orbit and selecting its frequency, that is to say, the number of complete orbits per second.

Rotational stirring (ES188622) consists of rotating the sample on an imaginary rotation axis which contains it.

Vibration or vortex stirring (ES2160401T3), (U.S. Pat. No. 4,883,644, U.S. Pat. No. 4,305,668, US2005/0180258) is generated through an orbital stirrer-like movement with high frequency, having said stirrer a very small orbit radius (usually less than 1 centimeter) thus generating the vibration transmitted by direct contact on the container base containing the sample.

Swinging stirring or swaying movement (ES219812Y) consists of making a platform oscillate alternately around an axis containing said platform. The containers which carry the sample are placed on this platform so that they perform this swaying movement.

Propeller stirring (ES2039656, US005141327A) consists of placing in the container with the sample a rod on whose end there is a propeller. The other end of the rod is connected to a rotating motor which makes it rotate, thus stirring the sample.

Magnetic stirring (ES2064649, DE202004013715U1, GB1180278, US2005088912, EP1188474) consists of placing in the container with the sample a cylinder-like, small, encapsulated magnet (so that it does not chemically react when in contact with the samples). A rotating magnetic field is generated below the container, making the magnet in the container spin at the same frequency as the rotating field does.

Pendular stirring (ES251833Y) consists of attaching the sample to a rod whose opposite end moves in an oscillating way, emulating the movement of a pendulum.

There exist some processes (chemical analyses, production of mixtures, extraction processes, etc.) in which the application of the previously described apparatuses does not produce an adequate homogenization and/or extraction of the stirred substances. In such cases the application of an axially oscillating movement is required, be it vertical, horizontal or with any other inclination between both options. From the countless axial orientations the oscillation can have, we have selected the vertical movement as an example thereof, without limiting the scope of this invention, which is defined exclusively by the claims. That is to say, when referring to oscillating vertical stirring, the sample must go up and down on a balance position, with a certain frequency and amplitude.

Nowadays, this vertical stirring movement is performed manually, which causes reproducibility and repeatability problems. The problem is even more noticeable when a large number of samples have to be stirred simultaneously.

Neither in the market nor in the consulted bibliography is there a system, apparatus, instrument or method which facilitates the performance of this oscillating vertical stirring in an automated way.

The invention hereby described solves the aforementioned problems as it is capable of stirring several samples jointly or individually and enabling to select the basic parameters of vertical stirring, which are: oscillation amplitude, oscillation frequency, acceleration, deceleration, and application time of the stirring effect as well as selection of stirring and rest cycles.

DESCRIPTION OF THE INVENTION

The present invention refers to an apparatus which axially stirs solid and/or liquid and/or gaseous substances individually or jointly.

The device object of the present invention presents a new concept in stirring since the movement is carried out by a linear motor; this facilitates a wide selection of parameters which characterize the oscillating axial movement of the samples. The oscillating movement is transmitted to the sample by fitting a support to a magnetic bar which is part of said motor (from now on, each time the word "motor" is used, it shall be understood we refer to the linear motor or the linear servo motor).

The motor is attached by means of a metallic structure, or a structure made of any other material which enables to fix the motor with the appropriate stiffness and resistance, and whose design does not limit the scope of the present invention, which is exclusively defined by the claims.

The structure supporting the motor has two holes, through which the magnetic bar crosses the structure and places itself in the cylindrical interior of the motor, driven by the electromagnetic forces of attraction and repulsion between the magnets of said bar and the magnetic fields generated by variable electric currents which move around the motor coils, thus transmitting the oscillating movement required.

For practical reasons, the lower platform functions as the base of the apparatus and it has rubber supports or silent blocks for good fixing and insulation from the possible vibrations produced in the oscillating movements. All of these form a very compact and stable block. The system may also have counterweights attached to the magnetic bar, or any other kind of mechanic system, for example springs which aim at reducing the motor strain, enhancing its performance and extending its lifespan.

Also, the present invention requires minimum maintenance. Other advantages of the present invention are its ease and speed of use, and parameters reproducibility such as oscillation amplitude, frequency, acceleration, stirring time and pauses between two consecutive applications, that is to say, the functioning mode. The apparatus may include software for the use of preset movement programmes, enabling the apparatus to adapt itself to many processes which require different movement conditions.

FIG. 1 shows a schematic view of the axially oscillating stirring system. Part (1) represents the linear motor. The rectangular part of the motor holds in its interior the coils which generate the magnetic fields, making currents of variable intensity circulate through them. There is a cylindrical hole which crosses the entire motor, it is in this hole that the axis or magnetic bar is located (part 2). The central upper part of this part (2) has a thread which enables to fix any element.

The parts (3) represent metallic bars with threads at their ends. These metallic bars fix the motor to the lower platform (part 4), the medium platform (part 5) and upper platform (part 6), keeping the motor (1) fixed and providing stability to the whole assembly.

Part (7) constitutes the lower part of the support of the containers (part 9) of the samples. This part (7) is joined to the magnetic bar (2) at the central, lower part so that both elements are fixed. Part (8) is the upper part of the tray which keeps the containers (9) with the samples fixed and is joined to piece (7) by its central part.

Below the lower platform (part 4) there are four rubber supports or silent blocks (10) which bear the whole weight and absorb great part of the vibrations. Part (11) protects the electrical connection board and the motor control connections (1).

Parts (12) are formed by a cylinder surrounded by a spring whose upper stop is a small platform (13) which can slide over the parts (12) against the force applied by the springs. The central area of the part (13) has a cylindrical groove to store some material to soften the abrupt contacts with the part (2).

PREFERRED EMBODIMENT

The present invention is illustrated by the following example which does not limit its scope, which is exclusively defined by the claims.

Stirring of a Mixture of Bovine Entrails and Liquid Solution in a Test Tube

To determine if a bovine consignment is fit for human consumption it is necessary to find out whether the animals have been treated with any non-authorized or non-desirable substance, for example antibiotics, hormones, beta-agonists, etc.

To that end, a significant sample of the entrails is needed, after this sample has been crushed, it is placed inside several test tubes along with an extractor solution which can interact with the possible substances being searched.

For its later analysis, these samples must be well fluidized, mixed and homogenized. To achieve this aim, 1 minute of strong stirring is necessary with an oscillation amplitude of 17.5 centimeters, and a frequency of 1.5 cycles per second. After this, it will be necessary to apply 12 minutes of stirring with a 10-centimetre amplitude and 70 m/s2 acceleration including 15-second pauses per minute of stirring.

After this procedure, the samples obtained from the stirring can be centrifuged for 5 minutes to 5.000 RPM, and after that, three kinds of clearly differentiated liquids as regards color and density are obtained. From each one of these liquids it is possible to obtain information about the substances the animal has received by means of chromatographic tests or any other chemical analysis technique.

BRIEF DESCRIPTION OF THE DRAWINGS

FIG. 1 shows a schematic view of the oscillating axially stirring system. Part (1) represents the linear motor. Part (2) is a bar with magnets inside.

Figure 1:
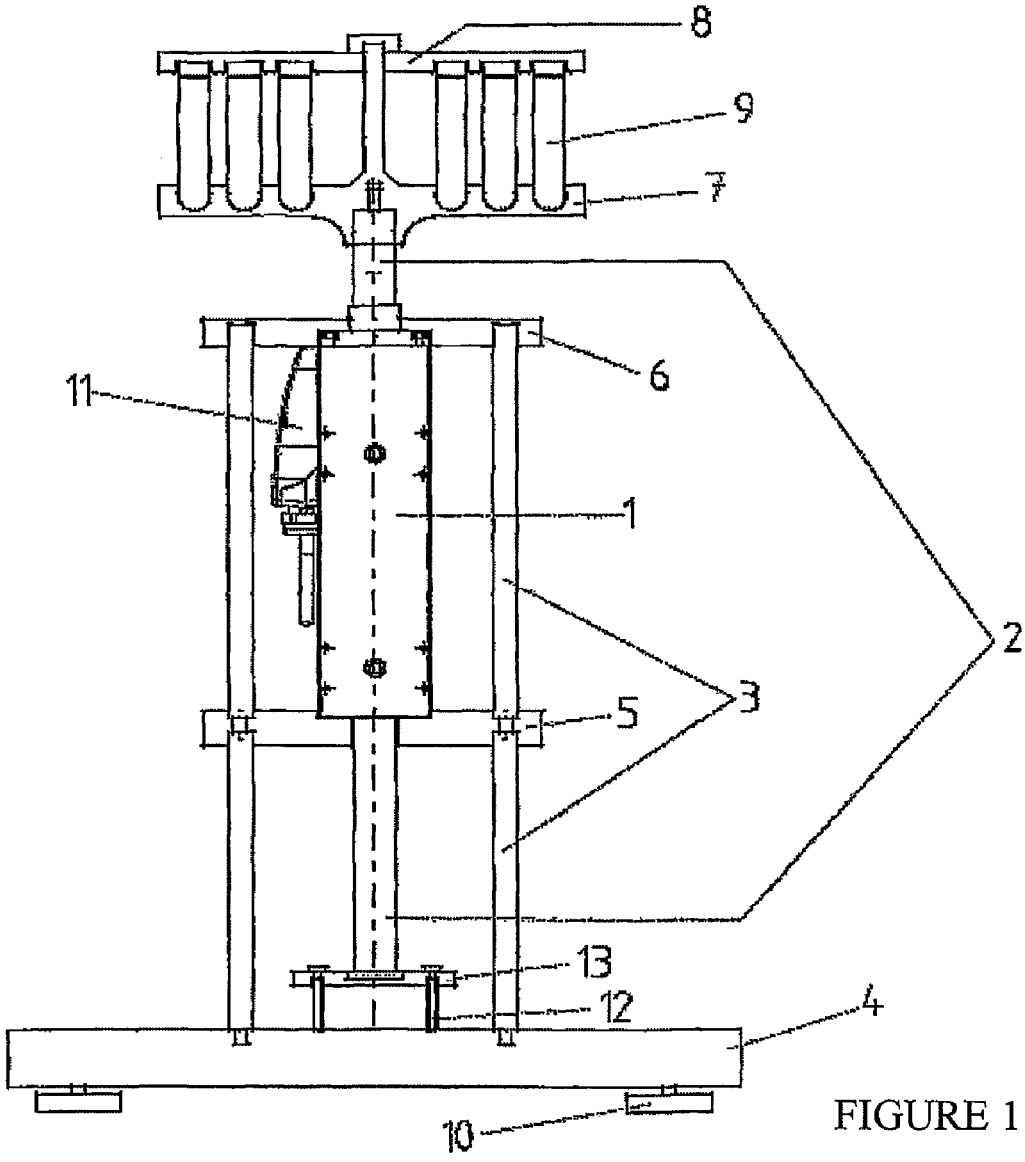
FIG. 1.

Parts (3) are metallic bars with threads at their ends. Parts (4), (5) and (6) are metallic platforms, or platforms made of any other material with a highly resistant structure. Part (7) is the base and part (8) is the lid of the containers support where the samples are kept. Parts (9) are the containers of the samples. Parts (10) are rubber supports, or supports made of any other material with similar characteristics. Part (11) protects the electrical connection board. Parts (12) are cylinders surrounded by springs and part (13) is a spring stop which also slides over the parts (12).

The invention claimed is:

1. An electromagnetic axial stirrer for solid and/or liquid and/or gaseous substances jointly or individually, comprising:

a linear motor or linear servo motor, configured to enable to select the amplitude, acceleration and application time of the stirring movement;

located between an intermediate platform and an upper platform;

a lower platform configured to support the stirrer;

a plurality of threaded bars at their ends;

located between:

the lower platform and the intermediate platform;

the intermediate platform and the upper platform;

configured to fix the motor to the lower platform, the intermediate platform and the upper platform;

a plurality of sample containers;

a base configured to support the sample containers;

a lid configured to cover the sample containers;

a magnetic bar containing the magnets which go through the linear motor located between the lower platform and joined by an upper end to the base.

2. An electromagnetic axial stirrer according to claim 1, wherein it comprises a plurality of damping supports on which the lower base rests.

3. An electromagnetic axial stirrer according to it is applied to mix the stirred substances claim 1, wherein it also comprises a connection board protector.

4. An electromagnetic axial stirrer according to claim 1, wherein it also comprises damping means comprising:

springs guided in cylinders;

a stop on the lower platform:

configured to slide over the damping means;

comprising a cylindrical groove to house some material to mitigate rough contacts of the magnetic bar.

5. An electromagnetic axial stirrer according to claim 1, wherein it also comprises frequency selection means configured to select a stirring frequency.

6. An electromagnetic axial stirrer according to claim 1, wherein it is configured to mix the stirred substances.

7. An electromagnetic axial stirrer according to claim 1, wherein it is configured to extract at least one constituent element contained in a stirred substance.

8. An electromagnetic axial stirrer according to claim 1, wherein it also comprises rotating means configured to rotate the apparatus in any angle with respect to a vertical position and perform the stirring movement in a direction other than the vertical.

9. An electromagnetic axial stirrer according to claim 1, wherein it is configured to standardize the processes in which stirring of one or several substances is necessary.

* * * * *